US010895851B2

(12) United States Patent
Matthey et al.

(10) Patent No.: US 10,895,851 B2
(45) Date of Patent: Jan. 19, 2021

(54) ACTIVE LIGHTING DEVICE TO BE WORN ON A PERSON'S WRIST

(71) Applicant: The Swatch Group Research and Development Ltd, Marin (CH)

(72) Inventors: Olivier Matthey, Mauborget (CH); Michel Willemin, Preles (CH); Bruno Scagliarini, Vallamand (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/524,391

(22) Filed: Jul. 29, 2019

(65) Prior Publication Data

US 2020/0073335 A1 Mar. 5, 2020

(30) Foreign Application Priority Data

Sep. 4, 2018 (EP) ..... 18192468

(51) Int. Cl.
*G04G 9/00* (2006.01)
*F21V 23/04* (2006.01)
(Continued)

(52) U.S. Cl.
CPC ..... *G04G 9/0041* (2013.01); *F21V 23/0492* (2013.01); *G04G 17/08* (2013.01); *F21W 2121/06* (2013.01); *F21Y 2115/10* (2016.08)

(58) Field of Classification Search
CPC .. G04G 9/0041; G04G 17/08; F21V 23/0492; F21W 2121/06
See application file for complete search history.

(56) References Cited

U.S. PATENT DOCUMENTS 5,548,565 A 8/1996 Aoyama et al.
6,213,619 B1 4/2001 Yu
(Continued)

FOREIGN PATENT DOCUMENTS

CN 102345838 A 2/2012
CN 103727405 A 4/2014
(Continued)

OTHER PUBLICATIONS

European Search Report dated Mar. 8, 2019 in European Application 18192468.9 filed on Sep. 4, 2018 (with English Translation of Categories of Cited Documents).
(Continued)

*Primary Examiner* — Sean P Gramling
(74) *Attorney, Agent, or Firm* — Oblon, McClelland, Maier & Neustadt, L.L.P.

(57) ABSTRACT

An active lighting device is placed on a person's wrist to light a path that the person is taking. The device is preferably in the form of a wristwatch. The device includes first light sources, which are controlled by a control unit. The first light sources are placed on a portion of a case. Each first light source activated by the control unit can produce a light beam of different orientation from another first light source activated by the control unit. The device further includes a motion sensor connected to the control unit to determine the wrist movement of the person wearing the device in order to allow the control unit to select certain first light sources to be activated depending on the person's wrist movement in order to light the path to be followed in the same defined forward direction.

15 Claims, 3 Drawing Sheets

(51) Int. Cl.

| | |
|---|---|
| ***G04G 17/08*** | (2006.01) |
| *F21Y 115/10* | (2016.01) |
| *F21W 121/06* | (2006.01) |

(56) References Cited

U.S. PATENT DOCUMENTS

| | | | | |
|---|---|---|---|---|
| 6,565,253 | B1 | 5/2003 | Yang | |
| 7,023,763 | B2 | 4/2006 | Galli | |
| 10,344,924 | B1 * | 7/2019 | Ganahl | F21V 15/04 |
| 2005/0018544 | A1 | 1/2005 | Galli | |
| 2005/0254229 | A1 | 11/2005 | Hamade et al. | |
| 2012/0140451 | A1 | 6/2012 | Araujo et al. | |
| 2017/0364156 | A1 * | 12/2017 | Kim | G06F 3/016 |

FOREIGN PATENT DOCUMENTS

| | | | |
|---|---|---|---|
| CN | 105135224 | A | 12/2015 |
| CN | 106322166 | A | 1/2017 |
| EP | 0 706 098 | A1 | 4/1996 |
| WO | WO 2016/110594 | A1 | 7/2016 |

OTHER PUBLICATIONS

Chinese Office Action issued in Chinese Patent Application No. 201910827878.5 dated Jul. 10, 2020, citing references AA and AO-AR therein (w/ English translation).

* cited by examiner

ACTIVE LIGHTING DEVICE TO BE WORN ON A PERSON'S WRIST

CROSS-REFERENCE TO RELATED APPLICATION

This application claims priority to European Patent Application No. 18192468.9 filed on Sep. 4, 2018, the entire disclosure of which is hereby incorporated herein by reference.

FIELD OF THE INVENTION

The invention concerns an active lighting device to be worn on a person's wrist, particularly for illuminating a path taken when the ambient light is insufficient. The wearable active lighting device can be in the form of an electronic or electromechanical watch, or a bracelet with electronic components.

STATE OF THE ART

To adequately illuminate a path or a road taken by a person on foot, it is known to use a wearable lighting device with suitable adjustment of the intensity of light generate by one or more light sources. Such a lighting device can also be used for a walk or a run in the dark. Such a lighting device can be placed, for example, on a person's head and manually switched on at the time of the walk or run in the dark.

US Patent Application No. 2018/0112839 A1, which discloses a bracelet with an orientable light source, can be cited in this regard. However, there is no description about the orientation of the light source taking into account the movement of the bracelet during a walk or run. Thus, such a bracelet with a light source does not properly illuminate the path taken by the walker or runner wearing said bracelet, which constitutes a drawback.

US Patent Application No. 2017/0241634 A1 discloses a bracelet with the possibility of attaching and connecting various light sources, but as in the preceding document, the light sources remain in a well defined direction and do not properly illuminate the path taken by the walker or the runner wearing said bracelet, which constitutes a drawback.

SUMMARY OF THE INVENTION

It is thus an object of the invention to overcome the aforementioned drawbacks to produce an active lighting device to be worn on a person's wrist, which is easy to use and uncomplicated in order to properly illuminate a path taken by the person while taking into account the movement of the person's wrist.

To this end, the invention concerns a wearable active lighting device placed on a person's wrist, which includes the features of the independent claim 1.

Particular embodiments of the lighting device are defined in the dependent claims 2 to 14.

One advantage of the lighting device according to the invention lies in the fact that, during use, the lighting device maintains the same direction of light generated by first light sources to illuminate a path to be followed by a person wearing the lighting device. Thus, the first light sources are selected by a control unit on the basis of the measurements of a motion sensor in order not the follow the movement of the person's wrist during a walk or run, so that an illumination is always maintained in the same forward direction.

Advantageously, second light sources can be provided, which are arranged in the lighting device to produce a backward illumination of a different colour from the forward illumination to signal the presence of the person using the lighting device to vehicles or other people coming from behind.

Preferably, the lighting device can be in the form of wristwatch, or simply a bracelet with electronic components. In the case of a wristwatch, the light sources can be mounted on a portion of the case, for example on a watch bezel, to each produce, once activated, a light beam in a radial direction outwardly of the case, i.e. substantially in a direction parallel to a dial and perpendicular to a case middle. Each light beam from an activated light source is in a different direction from another activated light source. Selection of the light sources to be activated is controlled by a control unit on the basis of the measurements of at least one motion sensor, such as a magnetometer or an accelerometer.

BRIEF DESCRIPTION OF THE DRAWINGS

The objects, advantages and features of a wearable active lighting device placed on a person's wrist will appear more clearly in the following description, based on at least one non-limiting embodiment illustrated by the drawings, in which.

DETAILED DESCRIPTION OF THE INVENTION

In the following description, reference is made to a wearable active lighting device to be placed on a person's wrist. All the electronic components, which are well known to those skilled in the art in this technical field, will be described only in a simplified manner. The lighting device can advantageously be in the form of a wristwatch or a bracelet with electronic components.

It is to be noted that 'in the form of a wristwatch' does not necessarily mean that it is intrinsically a wristwatch. However, the configuration of the lighting device is of identical shape to that of a wristwatch with a case, a crystal closing the top of the case to display information on a dial or a liquid crystal display, and a bracelet in one or two pieces connected to the case to place the lighting device around a person's wrist.

Figure 1:
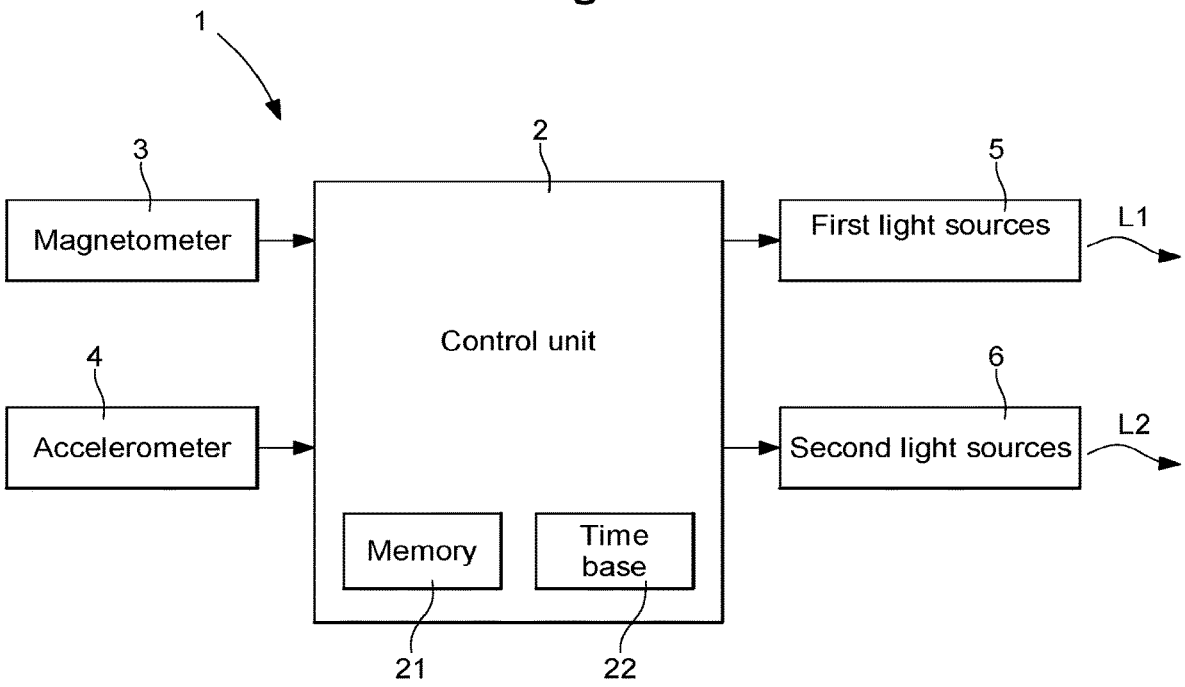
FIG. 1 represents a simplified block diagram of the components of the active lighting device of the invention.

FIG. 1 is a simplified view of the various main components of a wearable active lighting device 1 to be placed on a person's wrist according to the invention. Lighting device 1 is in the form of a wristwatch with at least one case connected by a bracelet in one or two pieces, or of a bracelet with electronic components. Lighting device 1 can also be a wristwatch as explained in FIGS. 2 to 4.

Lighting device 1 includes at least one motion sensor 3, 4 connected to a control unit 2, and at least first light sources 5 connected to control unit 2. Control unit 2 is connected to a continuous power source which is not represented. This electrical power source is preferably a DC voltage source that comes from a rechargeable or primary battery or is extracted and rectified from received electromagnetic radiation. Lighting device 1 can be manually activated by the action of a switch button or a touch button on the case or the crystal closing the case, as explained below with reference to the FIGS. 2 and 3.

For a lighting device 1 in the form of a wristwatch, first light sources 5 can be placed on the middle part of the case closed by a crystal, or on a bezel secured to the case middle as explained below with reference to the FIGS. 2 and 3. Lighting device 1 can also include second light sources 6 connected to control unit 2. These second light sources can also be placed on the case middle, for example of the watch case closed by a crystal, or on a bezel secured to the case middle.

Each first light source 5 is arranged to produce, once activated, a light beam of different orientation from every other light source. This therefore allows control unit 2 to automatically select certain first light sources 5, based on the measurements of the motion sensor 3, 4, so that an illumination L1 of the path followed by the person wearing lighting device 1 is always kept in the same direction. The selection of first light sources 5 depends on the wrist movement of the person wearing lighting device 1 to light the path to be followed in the same forward direction despite the wrist movement.

Each second light source 6 is also arranged to produce, once activated, a light beam of different orientation from every other light source. Based on the measurements of the motion sensor 3, 4, control unit 2 also automatically selects certain second light sources 6 to produce an illumination L2 opposite to illumination L1 while keeping illumination L2 in the same opposite direction to illumination L1.

In the case of a lighting device 1 with first and second light sources 5, 6, it is possible to envisage making illumination L1 of first light sources 5 a different colour from illumination L2 of second light sources 6. For example, illumination L1 for forward lighting of the person wearing lighting device 1 can be a white light, whereas illumination L2 for providing a backward light to signal the presence of the person walking or running on a path can be a red light.

Second light sources 6 can also be controlled by control unit 2 to provide a second, red, flashing illumination L2. This makes it possible to increase visibility to signal the presence of the person using the lighting device to vehicles or to other people coming from behind, and further reduces electric power consumption.

Naturally, it is also possible to have two-coloured first light sources 5. In such conditions, there are no second light sources 6, but the first light sources must be selected by the control unit to produce a forward illumination L1 of a first colour and a backward illumination L2 of a second colour during a walk or a run. Second illumination L2 can also be a flashing light.

Each first or second light source can be an LED light emitting diode, or a combination of two LED light emitting diodes, mounted, for example, head-to-tail to produce a light beam of a first colour in forward bias, or of a second colour different from the first colour in reverse bias.

Lighting device 1 can include two motion sensors, such as a magnetometer 3 and an accelerometer 4, to provide measurement signals to control unit 2. Magnetometer 3 and accelerometer 4 can be of the triaxial type. Said control unit 2 can also include at least one memory 21 for storing measurements made by the motion sensor(s) 3, 4 and at least one computational algorithm for the management and calculation of the measurements made by the sensors. Control unit 2 can also include its own time base 22 such as a low frequency oscillator, which may be a watch quartz oscillator or MEMS, in order to clock the operations of measuring and controlling the first and second light sources 5, 6. Thus, this control unit 2 can be a microcontroller.

It should also be noted that, once activated, control unit 2 can take into account, by means of at least one motion sensor 3, 4, the initial position of the wrist of the person wearing lighting device 1. This makes it possible to initially calibrate the direction of first illumination L1 and also that of second illumination L2 before starting the walk or run. Thus, a direction of illumination L1, for example, once calibrated, allows this direction of illumination L1 to be fixedly maintained regardless of the movement of the wrist, which is desired in order to properly light the path to be followed in the dark.

In principle, there is no adjustment of the light intensity of the various activated light sources, but it is sought instead to have maximum intensity for each illumination produced by the light sources activated by control unit 2.

Figure 2:
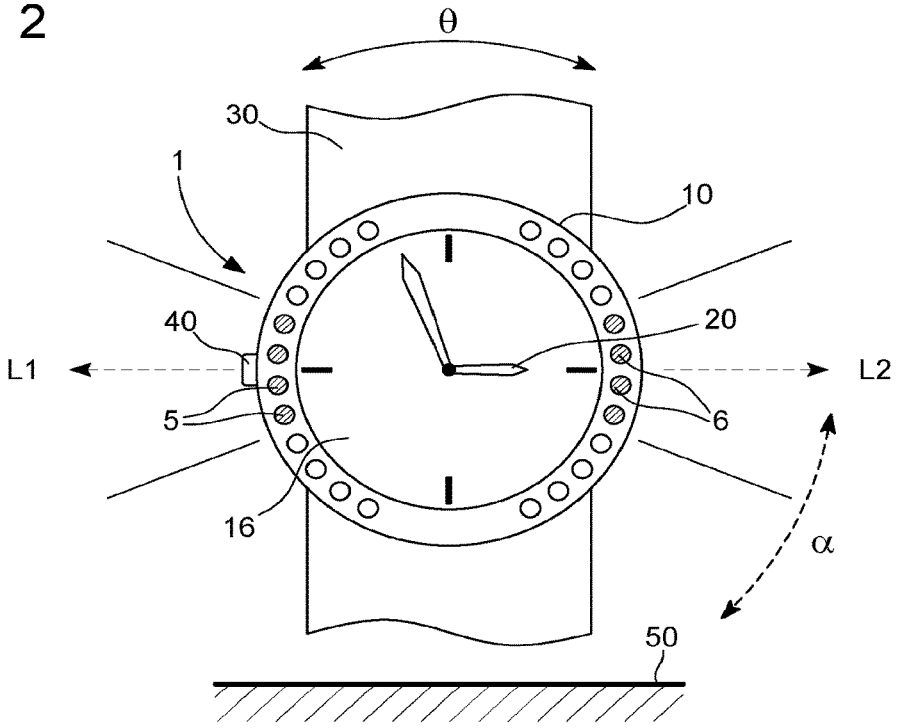
FIG. 2 represents a simplified view of an embodiment of a wearable active lighting device in the form of a wristwatch in the operating position according to the invention.
Figure 3:
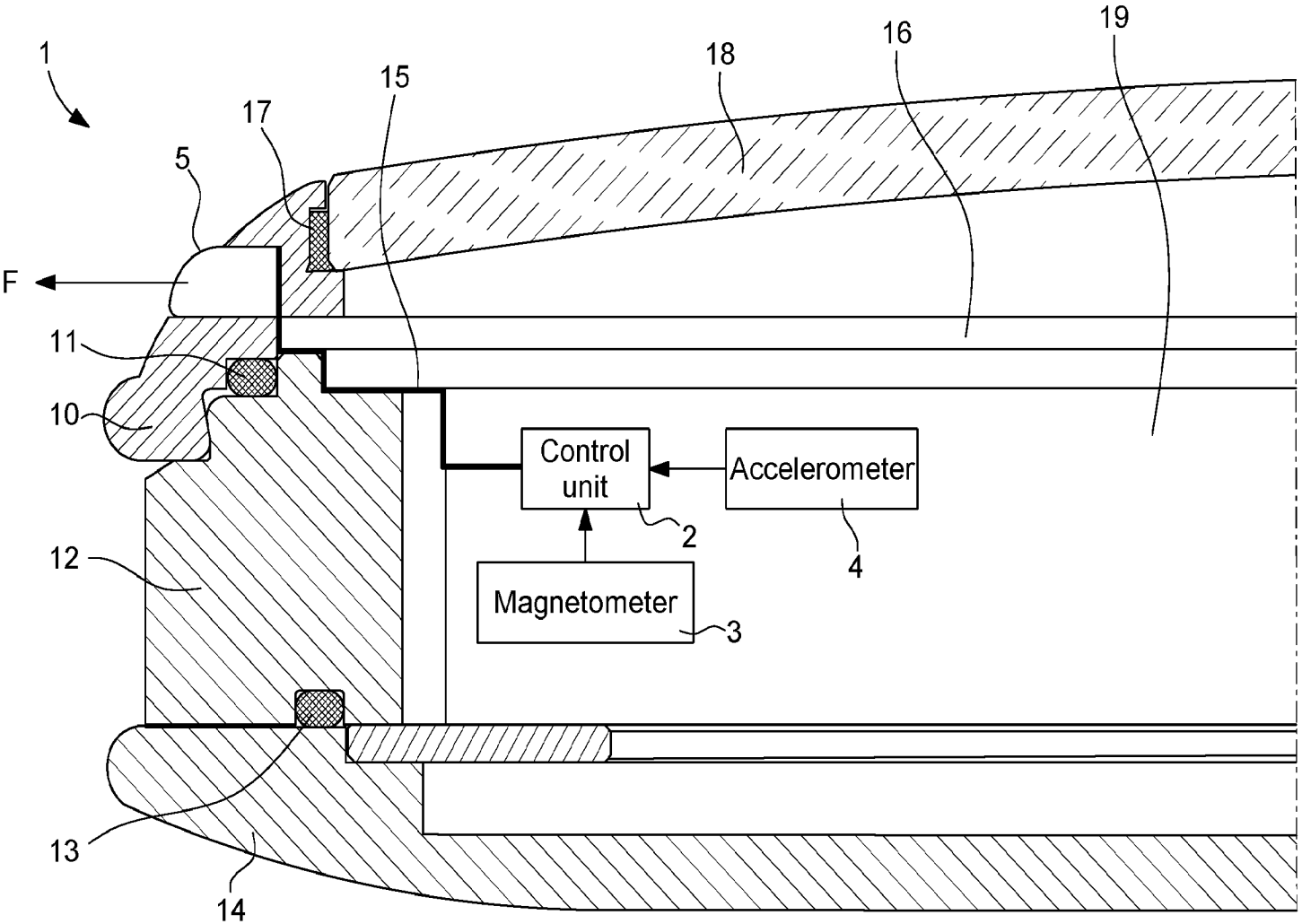
FIG. 3 represents a simplified, partial cross-sectional view of the embodiment of FIG. 2 of a wearable active lighting device in the form of a wristwatch according to the invention, and FIG. 4 schematically shows a wearable active lighting device in the form of a wristwatch worn on a person's wrist for lighting the path taken by the person according to the invention.

FIGS. 2 and 3 represent an embodiment of a wearable active lighting device 1 in an operating position. Lighting device 1 is a wristwatch here. This wristwatch 1 includes a case with a case middle 12 closed by a back cover 14 with a sealing gasket 13, the case being closed by a watch crystal 18 fixed by a gasket 17 to a bezel 10, which is itself attached to case middle 12 with another sealing gasket 11. A dial 16 and hands 20 for indicating the time can be seen through watch crystal 18. A bracelet 30 is connected to case middle 12 with a fastener for placing lighting device 1 on the wrist of a person using said device. A push button 40 in FIG. 2, which is mounted through case middle 12 for connection to control unit 2, is also provided for manually adjusting the time indication or for initialising and activating lighting device 1. A touch button can also be provided, connected to control unit 2 inside the case for initialising and activating lighting device 1.

Wristwatch 1 also includes inside the case a watch movement or an electronic watch module 19, and control unit 2 connected to one or two motion sensors 3, 4, which are a magnetometer 3 and an accelerometer 4, for example. Control unit 2 is electrically connected to each light source 5, 6, as specified below, by means of a flexible printed circuit board 15. Preferably, at least the first light sources 5 are placed partly inside cavities in bezel 10 and partly opening towards the exterior of bezel 10, particularly in the form of lenses.

As shown schematically in FIG. 2, first light sources 5 are placed on or partly inside watch bezel 10, which in this case is annular or circular in shape. Several first light sources 5 are provided, placed on a portion of a circle at the periphery of bezel 10, preferably regularly spaced apart from each other. First light sources 5 can be placed on a portion of a circle of up to 180° between midday and 6 o'clock. Each first light source 5 is electrically connected to control unit 2 arranged inside the watch case in order to be activated as a function of the measurements of motion sensor 3, 4, which is also arranged inside the watch case. Once activated, each first light source 5 can produce a light beam F, shown in FIG. 3, directed radially outwardly of the case, i.e. substantially in a direction parallel to dial 16 and perpendicular to case middle 12. Thus, each first light source 5 produces a light beam F of different orientation from another activated light source. Light beam F can be cone-shaped.

In the present case, to produce a first illumination L1, for example, four light sources 5 are provided, activated by control unit 2 and shown in grey in FIG. 2, and defining a first illuminated sector. The other first light sources 5 are inactive. However, during a movement of the person's wrist at an angle θ, control unit 2 performs another selection and activation of successive first light sources 5, for example four other selected and successive first light sources 5, to keep the same direction of illumination L1 at an angle α relative to the ground 50 of the path taken by the person wearing lighting device 1. First illumination L1 is the combination of four light beams F from four activated light sources 5. The direction of illumination L1 was stored in an initial position of the wrist following the manual action of push-button 40 of FIG. 2 at the moment of use of lighting device 1.

If used, the second light sources 6 are also placed on or partly inside annular or circular watch bezel 10. Several second light sources 6 are provided, arranged on a portion of a circle at the periphery of the bezel and preferably regularly spaced apart from each other. Second light sources 6 can be arranged on a portion of a circle of up to 180° between 6 o'clock and midnight. Each second light source 6 is electrically connected to control unit 2 arranged inside the watch case in order to be activated as a function of the measurements of motion sensor 3, 4, which is also arranged inside the watch case. Once activated, each second light source 6 can produce a light beam directed radially outwardly of the watch case, i.e. substantially in a direction parallel to the watch dial and perpendicular to the case middle. Thus, each second light source 6 produces a light beam of different orientation from another activated second light source. The number of second light sources 6 can be equal to the number of first light sources 5 to produce a second illumination L2 opposite to first illumination L1.

In the present case, to produce second illumination L2, for example, four second light sources 6 are provided, activated by control unit 2 and shown in grey in FIG. 2, and defining a second illuminated sector opposite to the first illuminated sector. The other second light sources 6 are inactive. However, during a movement of the person's wrist at an angle θ, control unit 2 performs another selection and activation of successive second light sources 6, for example four other selected and successive second light sources, to keep the same direction of illumination L2 at an angle α relative to the ground 50 of the path taken by the person wearing lighting device 1. Second illumination L2 is the combination of four light beams from four activated second light sources 6. The direction of illumination L2 was stored in an initial position of the wrist following the manual action of push-button 40 at the moment of use of lighting device 1. First illumination L1 can be white, whereas second illumination L2 can be red, for example.

It is to be noted that it is also possible to envisage having only two-coloured first light sources over the entire periphery of bezel 10. In such conditions, each first light source 5 includes two light emitting diodes mounted head-to-tail. In this manner, control unit 2 can activate first light sources 5 producing a white light beam on a first illuminated sector, and other first light sources 5 producing a red light beam on a second illuminated sector.

In FIG. 3, first light sources 5 can be arranged over the entire periphery of bezel 10, partly inside cavities in bezel 10. If second light sources are also used, it is also possible to envisage placing them over the entire periphery of bezel 10 above or below first light sources 5 and in a coaxial manner. Electrical connection of each second light source to control unit 2 can be achieved via flexible printed circuit board 15, which is arranged to pass underneath dial 16.

Figure 4:
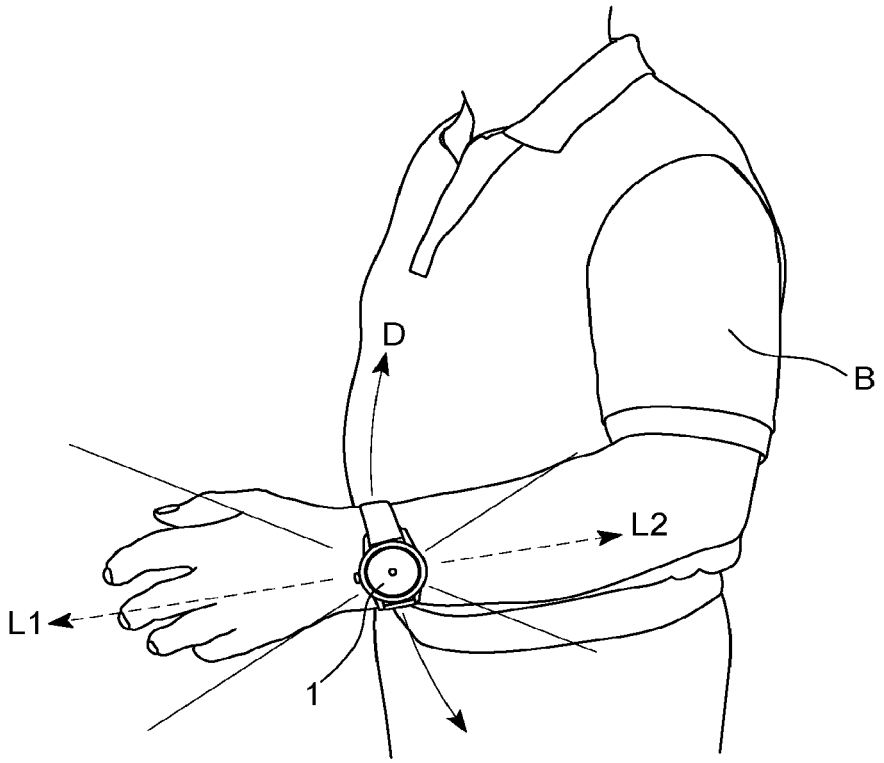

FIG. 4 schematically shows a wearable active lighting device 1 in the form of a wristwatch worn on a person's wrist for lighting the path taken by the person. In this case, the wristwatch is worn on the wrist of the left arm B, but it is also possible to envisage making the same wristwatch to be worn on the wrist of the right arm. It is noted that, during the upward movement in direction D of arm B with the wrist, first illuminations L1 and L2, initially calibrated at the start of use of lighting device 1, always remain in the same direction of illumination—forwards for first illumination L1 and backwards for second illumination L2. This clearly lights the path taken by the person wearing lighting device 1 during a walk or run on a path or a road.

It is to be noted that first light sources 5, or second light sources 6, can be placed on an external wall of watch case middle 12 in FIG. 3, or in external cavities of case middle 12, rather than on or inside bezel 10. The arrangement of the light sources can be identical to that described above with reference to FIGS. 2 and 3.

It is also to be noted that the shape of the case can be different from a generally cylindrical shape, i.e. circular seen from above. It can be of elliptical shape seen from above, or rectangular or otherwise. In such conditions, the light sources must be properly oriented, for example on an edge of the case middle or on an external wall of the case middle in order to allow light sources to be selected for activation whatever the movement of the wrist and always have a uniform forward illumination without variation.

The lighting device can also be a bracelet with electronic components, wherein the first light sources, or the second light sources, can be mounted on the lateral edge of the bracelet. The light sources must also be properly oriented to produce at least the first forward illumination without variation.

From the description that has just been given, several variants of an active lighting device to be worn on a person's wrist are possible without departing from the scope of the invention defined by the following claims.

The invention claimed is:

1. An active lighting device to be worn on a person's wrist to light a path taken by the person wearing the lighting device, the lighting device being in the form of a wristwatch having at least a case closed by a crystal and a bracelet connected to a middle part of the case, or of a bracelet with electronic components, the device comprising:

a plurality of first light sources, which are controlled by a control unit of the device, the plurality of first light sources being placed on a first portion of a case or of a bracelet;

a plurality of second light sources which are controlled by the control unit, the plurality of second light sources being placed on a second portion of the case or of the bracelet, the second portion positioned on an opposite side of the case or bracelet from the first portion; and at least one motion sensor connected to the control unit to determine the wrist movement of the person wearing the device, wherein each first light source activated by the control unit is arranged to produce a light beam of different orientation from each of the other first light sources activated by the control unit, wherein each second light source activated by the control unit is arranged to produce a light beam of different orientation from each of the other second light sources activated by the control unit, wherein the plurality of first light sources are positioned adjacent each other on the first portion, and the plurality of second light sources are positioned adjacent each other on the second portion, wherein the control unit is arranged to select certain second light sources of the plurality of second light sources to be activated depending on the determined movement of the person's wrist, and wherein the control unit is arranged to select certain first light sources of the plurality of first light sources to be activated depending on said determined movement of the person's wrist in order to light the path to be followed in a same defined forward direction.

2. The active lighting device according to claim 1, wherein the plurality of second light sources activated by the control unit, as a function of the measurements made by the motion sensor, produce a second illumination in an opposite direction to a first illumination produced by the plurality of first light sources activated by the control unit.

3. The active lighting device according to claim 2, wherein the plurality of first and second light sources are light emitting diodes.

4. The active lighting device according to claim 1, wherein the plurality of first light sources each include two light emitting diodes mounted head-to-tail, wherein a first light emitting diode produces a light beam of a first colour once activated, whereas the second light emitting diode produces a light beam of a second colour different from the first colour once activated.

5. The active lighting device according to claim 1, wherein the motion sensor is a magnetometer or an accelerometer.

6. The active lighting device according to claim 1, wherein the device includes two motion sensors, which are a magnetometer and an accelerometer.

7. The active lighting device according to claim 1, wherein the control unit includes a memory for storing measurements made by one or two motion sensors and at least one computational algorithm for the management and calculations of measurements made by the sensors, and a time base having a low frequency oscillator for clocking the operations of measuring and selecting the light sources to be activated.

8. The active lighting device according to claim 7, wherein the control unit, once manually activated, determines the initial position of the lighting device placed on a person's wrist in order to calibrate and initially store the direction of a first forward illumination produced by first light sources activated and selected by the control unit.

9. The active lighting device according to claim 1, wherein the lighting device is in the form of a wristwatch with a case of generally cylindrical shape, wherein the first light sources are mounted on or partly inside a bezel of circular shape, fixed to a middle part of the case.

10. The active lighting device according to claim 9, wherein several first light sources are placed at least on a portion of a circle less than or equal to 180° at the periphery of the bezel while being preferably regularly spaced apart from each other.

11. The active lighting device according to claim 10, wherein several second light sources are placed on at least one other portion of a circle less than or equal to 180° at the periphery of the bezel and facing the first light sources, and wherein the second light sources are regularly spaced apart from each other.

12. The active lighting device according to claim 9, wherein the plurality of first light sources are placed over the entire periphery of the circular bezel while preferably being regularly spaced apart from each other.

13. The active lighting device according to claim 12, wherein the first light sources each include two light emitting diodes mounted head-to-tail, wherein a first light emitting diode produces a light beam of a first colour once activated, whereas the second light emitting diode produces a light beam of a second colour different from the first colour once activated, and wherein certain first light sources selected and activated by the control unit produce a first, white, forward illumination, whereas certain other first light sources activated and selected by the control unit produce a second, red, backward illumination.

14. The active lighting device according to claim 2, wherein the second illumination produced by the first or second activated light sources is a flashing light.

15. The active lighting device according to claim 13, wherein the second illumination produced by the first or second activated light sources is a flashing light.

* * * * *